United States Patent [19]

Sakai

[11] 4,387,147

[45] Jun. 7, 1983

[54] ELECTROPHOTOGRAPHIC ELEMENT CONTAINING HYDRAZONE COMPOUNDS IN CHARGE TRANSPORT LAYERS

[75] Inventor: Kiyoshi Sakai, Numazu, Japan

[73] Assignee: Ricoh Co., Ltd., Tokyo, Japan

[21] Appl. No.: 212,306

[22] Filed: Dec. 3, 1980

[30] Foreign Application Priority Data

Dec. 8, 1979 [JP] Japan ..... 54-158725

[51] Int. Cl.[3] ..... G03G 5/14

[52] U.S. Cl. ..... 430/58; 430/59; 430/900; 564/251

[58] Field of Search ..... 430/58, 59, 80, 900; 260/566 B

[56] References Cited

U.S. PATENT DOCUMENTS 4,150,987 4/1979 Anderson et al. ..... 430/58

4,175,960 11/1979 Berwick et al. ..... 430/58

*Primary Examiner*—John D. Welsh

*Attorney, Agent, or Firm*—Flynn, Thiel, Boutell & Tanis

[57] ABSTRACT

An electrophotographic element which comprises a conductive substrate and a photosensitive layer, superposed thereon, consisting of a charge generation layer and a charge transport layer, said charge transport layer containing as an available ingredient a hydrazone compound having the following general formula (I):

(I)

(where R is a hydrogen atom, an alkyl group, of from one to six carbon atoms, an alkoxyl group of from one to six carbon atoms, a substituted or non-substituted dialkylamino group, halogen, a nitro group or a hydroxyl group. n is an integer of 1–5. In case where n is 2 or more, R may be the same or different.).

14 Claims, 1 Drawing Figure

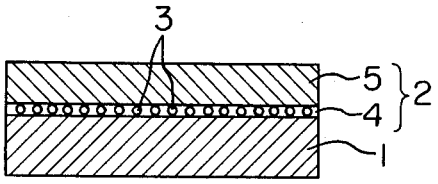
3
5
4
2
1

ELECTROPHOTOGRAPHIC ELEMENT CONTAINING HYDRAZONE COMPOUNDS IN CHARGE TRANSPORT LAYERS

BACKGROUND OF THE INVENTION (1) Field of the Invention

This invention relates in general to an electrophotographic element and in particular a novel electrophotographic element comprising a charge generation layer and a charge transport layer which contains as an available ingredient at least one hydrazone compound of those having the following general formula (I):

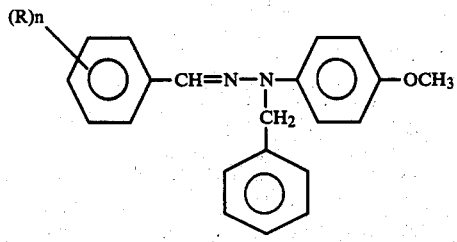

(I)

(where R is a hydrogen atom, a lower alkyl group, a lower alkoxyl group, a substituted or non-substituted dialkylamino group such as dimethylamino, diethylamino, ethylchloroamino or the like, halogen such as chlorine, bromine or the like, a nitro group or a hydroxyl group. n is an integer of 1–5. In case where n is 2 or more, R may be the same or different.)

(2) Description of the Prior Art

Inorganic substances such as selenium, cadmium sulfide, zinc oxide, etc. have hitherto been utilized as photoconductive materials for use in elements in electrophotographic processes. In this context, it is to be noted that the term "electrophotographic process" referred to herein generally denotes one of the image forming methods which comprise the steps of electrifying a photoconductive element in the dark first of all for instance with corona discharge or the like, then exposing the element to light in an imagewise manner to selectively dissipate the charge from only the light struck portions of the element thereby forming a latent image, and rendering the latent image visible by means of a developing process utilizing an electroscopic fine powder comprising a coloring agent called a toner, such as a dye, pigment or the like, and a binder resin such as a high molecular substance or the like, thereby forming a visible image. The element adapted for the above-mentioned electrophotographic process is required to possess the following fundamental characteristics: (1) the capability of being charged with a suitable potential in the dark, (2) low discharge rate in the dark, (3) rapid dischargeability upon light radiation and so forth. The hitherto utilized inorganic substances as enumerated above surely possess a number of merits, but at the same time possess various demerits. For instance, the now universally utilized selenium can satisfy the aforesaid requirements (1) to (3) to a sufficient degree, but is defective in that it is manufactured with difficulty and consequently the manufacturing cost is high. In addition, the selenium is defective in that it is difficult to process the selenium, which has no flexibility, into a belt, close attention must be paid in handling the selenium which is very sensitive to mechanical impact, and the like. On the other hand, cadmium sulfide and zinc oxide are utilized in the element by dispersing them in a binder resin. However, such element lacks the mechanical characteristics such as smoothness, hardness, tensile strength, frictional resistance, and therefore, as it is, can not stand repeated use.

In recent years, electrophotographic elements employing various kinds of organic substances have been proposed in order to remove the drawbacks inherent in the inorganic substances as enumerated above. Some of said elements are put to practical use, for instance, such as the element including poly-N-vinylcarbazole and 2,4,7-trinitrofluorene-9-one (U.S. Pat. No. 3,484,237), the element including poly-N-vinylcarbazole sensitized with a pyrylium salt type pigment (Japanese Patent Publication No. 25658/1973), the element including an organic pigment as the principal ingredient (Japanese Laid-Open Patent Application No. 37543/1972), the element including a cocrystalline complex consisting of dye and resin as the principal ingredient (Japanese Laid-open Patent Application No. 10735/1972; etc.

As prior art relating to the elements which comprise laminating a charge transport layer on a charge generation layer using amorphous selenium or selenium alloy wherein each layer is adapted for playing its own allotted part there can be enumerated Japanese Patent Publication No. 5349/1970, Japanese Patent Publication No. 3168/1974, Japanese Patent Publication No. 14914/1975, and Japanese Patent Publication No. 10982/1976.

In addition thereto, the undermentioned elements have been developed which are prepared by laminating a charge transport layer on a charge generation layer containing a pigment of any kind. U.S. Pat. No. 3,837,851 discloses an element comprising a charge generation layer and a charge transport layer containing at least one triarylpyrazoline, U.S. Pat. No. 3,850,630 discloses an element comprising a transparent charge transport layer and a charge generation layer containing indigoid pigment, U.S. Pat. No. 3,871,882 discloses a charge generation layer containing a perylene pigment derivative and a charge transport layer containing a condensate of 3-bromopyrene and formaldehyde, and Japanese Laid-open Patent Application No. 133445/1978 discloses an element comprised of a charge generation layer containing a stilbene skeleton type disazo pigment. Some of aforesaid elements have already been put on the market, but the fact is that they do not have the various properties required for elements to a satisfactory degree.

On the other hand, it is perceivable that these excellent elements, though there are differences therebetween depending on their objects or manufacturing processes, can generally be made to exhibit superior characteristics by incorporating highly efficient photosensitive materials therein.

SUMMARY OF THE INVENTION

The inventor has made a series of studies on charge transport materials of this kind and has discovered that said hydrazone compound having the general formula (I) acts effectively as the charge transport material for electrophotographic elements. In other words, the inventor has discovered that the hydrazone compound (I), as referred to subsequently, when combined with various kinds of materials, can provide elements capable of exhibiting unexpectedly superior effects and rich in surprisingly versatile usability.

The hydrazone compound having the general formula (I) referred to in this invention is prepared in any usual manner, in other words, by bringing about a condensation reaction between equimolecular weights of benzaldehydes and 1-benzyl-1-anishydrazines in alcohol, and if needed, by adding a small quantity of acid (glacial acetic acid or mineral acid). There are instances where said hydrazines preferably should be used in a slightly excess quantity at the time of effecting the condensation reaction for the purpose of facilitating the purification of the obtained products.

The compounds corresponding to the aforesaid general formula (I) can be enumerated as follows:

(1)

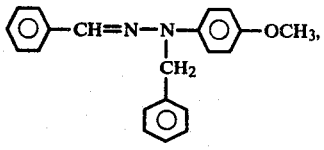

(2)

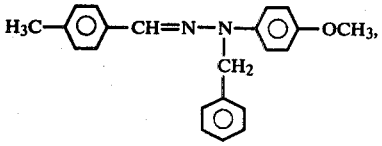

(3)

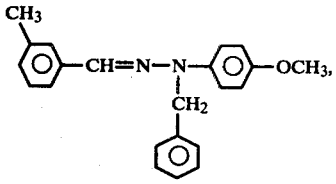

(4)

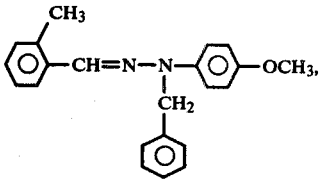

(5)

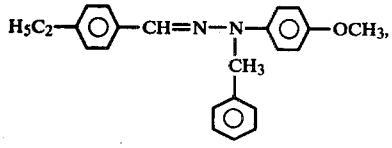

(6)

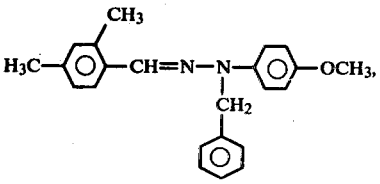

(7)

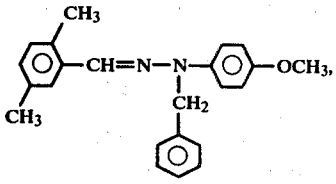

-continued (8)

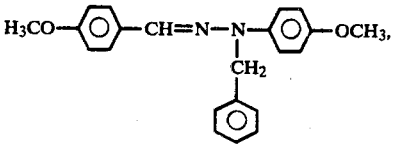

(9)

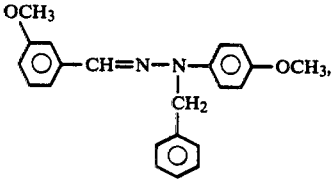

(10)

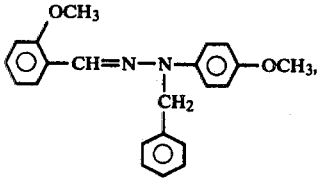

(11)

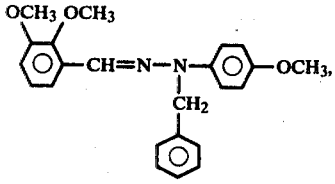

(12)

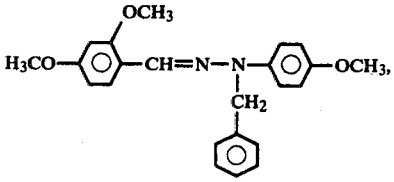

(13)

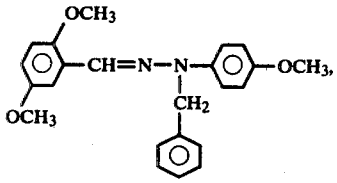

(14)

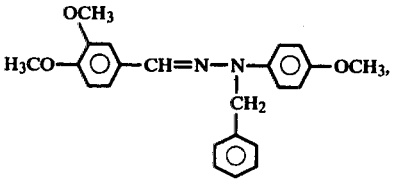

(15)

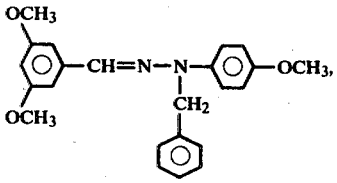

-continued
(16)
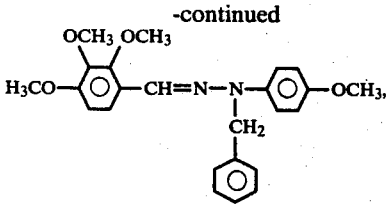
(17)
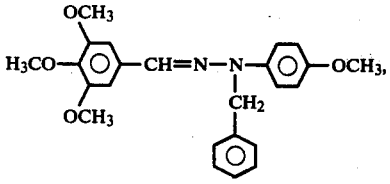
(18)
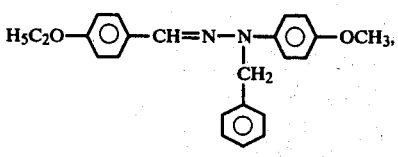
(19)
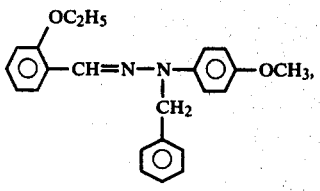
(20)
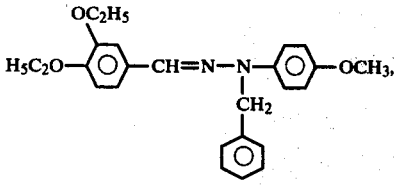
(21)
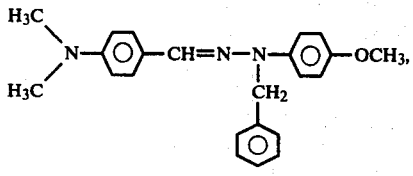
(22)
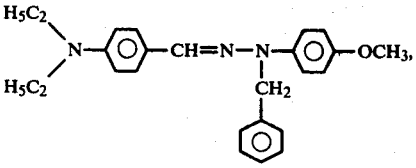
(23)
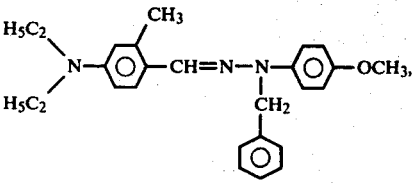
(24)
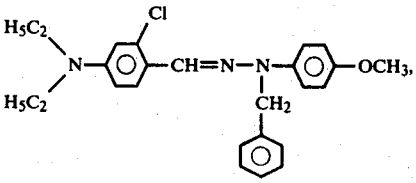
-continued
(25)
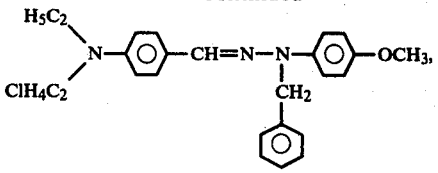
(26)
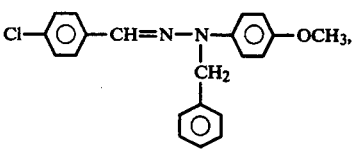
(27)
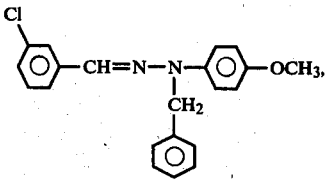
(28)
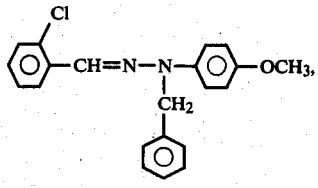
(29)
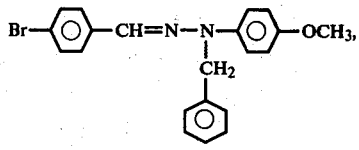
(30)
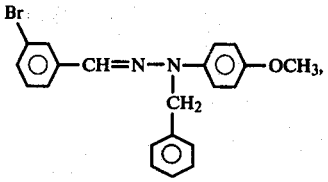
(31)
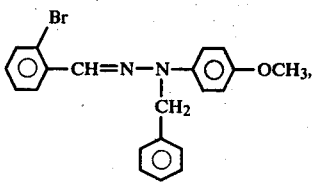
(32)
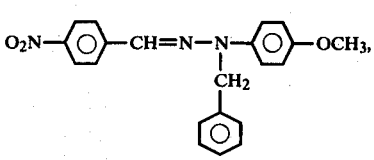
(33)
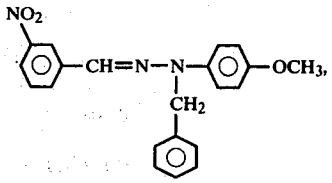

-continued (34)

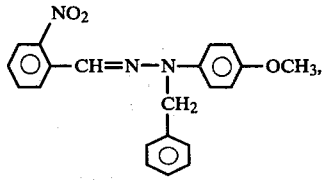

(35)

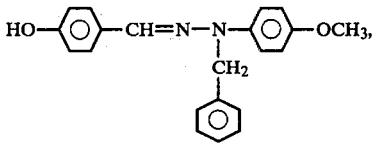

(36)

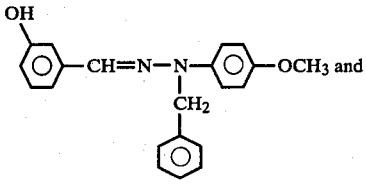

(37)

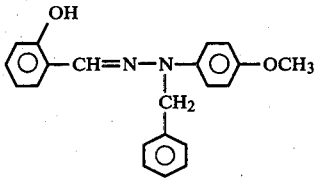

BRIEF DESCRIPTION OF THE DRAWING

The appended drawing is an enlarged cross-sectional view of the electrophotographic element according to this invention.

The Figure illustrates one embodiment of the electrophotographic element according to this invention which comprises a conductive substrate 1 and a photosensitive layer 2, superposed thereon, consisting of a charge generation layer 4 containing mainly a charge generation material 3 and a charge transport layer 5 containing a hydrazone compound having the general formula (I).

The hydrazone compound (I), which is a charge transport material, forms a charge transport media in conjunction with a binder (and a plasticizer as occasion demands), while the charge generation material, such as an inorganic or organic pigment, generates charges. In this case, the main ability of the charge transport media is to receive charges generated from the charge generation material and transport said charges. It is to be noted that what is fundamentally required in this instance is that the absorption wave length regions of both the charge generation material and the hydrazone compound (I) should not overlap each other mainly in the visible light region. This is because there is the necessity for permitting light to permeate to the surface of the charge generation material so that the latter may generate charges efficiently. The hydrazone compound (I) according to this invention is characterized in that it is scarcely absorptive in the visible light region and generally acts as the charge transport material effectively, especially when combined with the charge generation material capable of generating charges upon absorbing light in the visible region.

The light permeating through the charge transport layer 5 arrives at the charge generation layer 4 to thereby generate charges at the light struck portions thereof, while the thus generated charges are injected in the charge transport layer 5 and transported therethrough. The mechanism employed herein is that the generation of charges required for effecting light decay is allotted to the charge generation material, while the transportion of the charges is allotted to the charge transport medium (the hydrazone compound (I) mainly acts for the purpose).

This element may be prepared by vacuum-evaporating a charge generation material onto a conductive substrate, or coating onto a conductive substrate a dispersion obtained by dispersing fine particles of the charge generation material, if needed, in a suitable solvent in which a binder is dissolved, and then by coating a solution containing the hydrazone compound (I) and a binder onto the charge generation layer. If needed, this can be done after surface finishing or regulating the film thickness by, for instance, buffing or the like, and then drying. The coating method used herein includes the usual means, such as a doctor blade, wire bar or the like.

Referring to the thickness of the photosensitive layer, it is desired that the charge generation layer be between about 0.01 and 5 microns thick, preferably between about 0.04 and 2 microns thick, and the charge transport layer be between about 3 and 50 microns thick, preferably between about 5 and 20 microns thick.

In this element, the percentage of the hydrazone compound (I) in the charge transport layer is in the range of from 10 to 95% by weight, preferably from 30 to 90% by weight.

In this context, it is to be noted that a plasticizer may be used in conjunction with a binder in the preparation of this element.

In the case of the element according to this invention, as the conductive substrate there can be employed a metallic plate or foil of, an aluminum or the like evaporation deposited plastic film of aluminum or the like, a conductively treated paper, or the like. As the binder suitably used for this invention there may be generally enumerated condensation resins such as polyamide, polyurethane, polyester, epoxy resin, polyketone, polycarbonate, etc., vinyl polymers such as polyvinyl ketone, polystyrene, poly-N-vinylcarbazole, polyacrylamide, and the like. In this connection, however, it is to be noted that any insulating as well as adhesive resin may be employed for this purpose. As the plasticizer for use in this invention there may be enumerated paraffin halide, polybiphenyl chloride, dimethylnaphthalene, dibutyl phthalate and so forth.

The charge generation materials for use in this invention include inorganic pigments such as selenium, selenium-tellurium, cadmium sulfide, cadmium sulfide-selenium, etc. and organic pigments such as CI Pigment Blue-25 (CI 21180), CI Pigment Red 41 (CI 21200), CI Acid Red 52 (CI 45100), CI Basic Red 3 (CI 45210), the azo pigment having a carbazole skeleton (Japanese Laid-open Patent Application No. 95966/1978), the azo pigment having a styryl stilbene skeleton (Japanese Patent Application No. 48859/1977), the azo pigment having a triphenylamine skeleton (Japanese Patent Application No. 45812/1977), the azo pigment having a dibenzothiophene skeleton (Japanese Patent Application No. 86255/1977), the azo pigment having an oxadiazole skeleton (Japanese Patent Application No. 77155/1977), the azo pigment having a fluorenone skeleton (Japanese Patent Application No. 87351/1977), the azo pigment having a bisstilbene skeleton (Japanese Patent Application No. 81790/1977), the azo pigment having a distyryloxadiazole skeleton (Japanese Patent Application No. 66711/1977), the azo pigment having a distyrylcarbazole skeleton (Japanese Patent Application No. 81791/1977), etc.; phthalocyanine type pigments such as CI Pigment Blue 16 (CI 74100), etc.; indigo type pigments such as CI Vat Brown 5 (CI 73410), CI Vat Dye (CI 73030), etc.; perylene type pigments such as Argoscarlet B (available from Bayer Company), Indanthrene Scarlet B (available from Bayer Company) and so forth.

In this connection , it is to be noted that the element obtained as aforesaid can contain an adhesive or barrier layer, if needed, interposed between the conductive substrate and the photosensitive layer. The materials available suitably for said adhesive or barrier layer include polyamide, nitrocellulose, aluminum oxide, etc., and preferably the film of said layer is 1 micron or less thick.

The copying process using the element of this invention can be achieved by electrifying the surface of the element, exposing the same to light, thereafter developing and, if needed, transferring the thus formed image onto paper or the like.

The element according to this invention is advantageous in that it is generally of a high sensitivity and a bound in flexibility.

DESCRIPTION OF THE PREFERRED EMBODIMENTS

In the undermentioned examples, all parts are by weight.

EXAMPLE 1

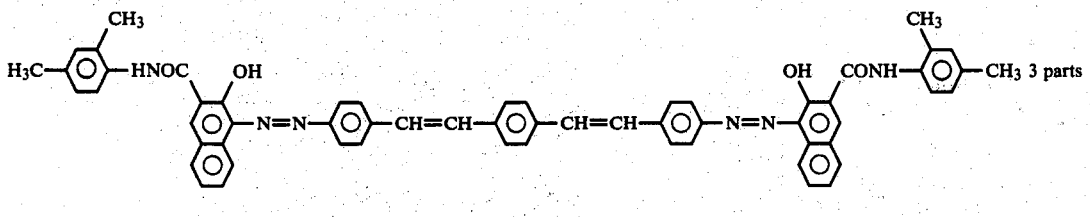

Polyester resin (polyester available from Du Pont: Adhesive 49000)—1 part
Tetrahydrofuran—96 parts A solution comprising the abovementioned components was pulverized and mixed in a ball mill, thereby obtaining a charge generation pigment solution. The resulting solution was coated onto an aluminum evaporation deposited polyester film by means of a doctor blade and dried for 5 minutes in a dryer heated to 80° C. thereby to form a 1 micron-thick charge generation layer. Subsequently, a charge transport layer forming solution was obtained by mixing 2 parts of hydrazone having the structural formula (8), 3 parts of polycarbonate resin (available under the Trademark Panlite L from (TEIJIN) and 45 parts of tetrahydrofuran and dissolving them well. This solution was coated onto said charge generation layer by means of a doctor blade and the same was dried at 100° C. for 10 minutes, thereby forming a charge transport layer about 10 microns thick. The instant element was thus prepared.

This element was subjected to −6 KV corona discharge for 20 seconds by means of an electrostatic copying paper tester (SP408 type available from KAWAGUCHI DENKI SEISAKUSHO K.K.) and charged negatively. Thereafter, the negatively charged element was left standing in the dark for 20 seconds in order to measure the surface potential Vpo(V) at that time, and then was exposed to light from a tungsten lamp so that the surface intensity became 20 lux. Then the time (seconds) required until the surface potential was reduced to half of said Vpo was measured to determine the exposure amount $E\frac{1}{2}$(lux·sec). The thus obtained results showed: Vpo = −1130 and $E\frac{1}{2}$ = 1.7 lux sec. Likewise, the time (seconds) required until the surface potential was reduced to 1/10 of said Vpo was measured for determining the exposure amount E1/10 (lux·sec). The obtained result shows: E1/10 = 3.7 lux·sec. Still further, the residual potential $V_{30}$ after 30 seconds' exposure was calculated, showing $V_{30}$ = 0 volt.

EXAMPLES 2 to 5

The same procedure as Example 1 was repeated with the exception that the hydrazone compounds having structural formulas (2), (1), (29) and (26) were employed respectively therein in lieu of the hydrazone compound having the structural formula (8), thereby obtaining the elements according to this invention. Then, the resulting elements were tested. The obtained test results are as shown in Table-1.

TABLE-1

| Example | Hydrazone compound | Vpo (V) | E1/2 (lux.sec) | E1/10 (lux.sec) | $V_{30}$ (V) |
|---|---|---|---|---|---|
| 2 | (2) | −1240 | 1.7 | 3.9 | 0 |
| 3 | (1) | −1290 | 1.7 | 4.1 | −7.8 |
| 4 | (29) | −1190 | 1.7 | 4.9 | −17.6 |
| 5 | (26) | −1360 | 1.9 | 6.3 | −29.3 |

EXAMPLE 6

The same procedure as Example 1 was repeated with the exception that the compound having the following general formula was employed as the charge generation pigment, thereby obtaining an element:

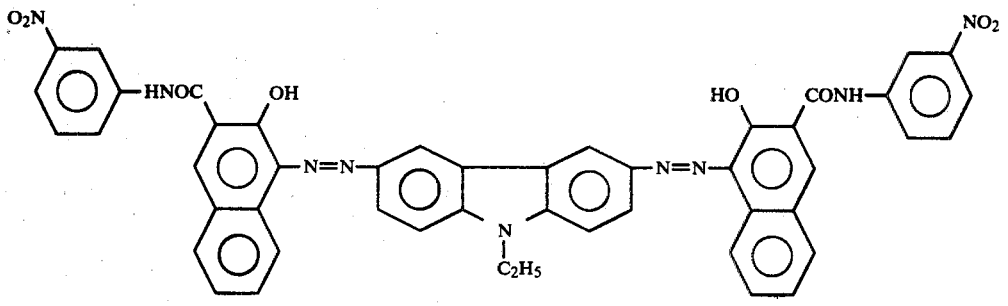

The resulting element was measured as to Vpo and $E_{\frac{1}{2}}$ with the results:

Vpo = −650 V and $E_{\frac{1}{2}}$ = 8.4 lux·sec.

EXAMPLE 7

The same procedure as Example 1 was repeated with the exception that the compound having the following formula was employed as the charge generation pigment and the hydrazone having the structural formula (1) was employed as the charge transport material, thereby obtaining an element:

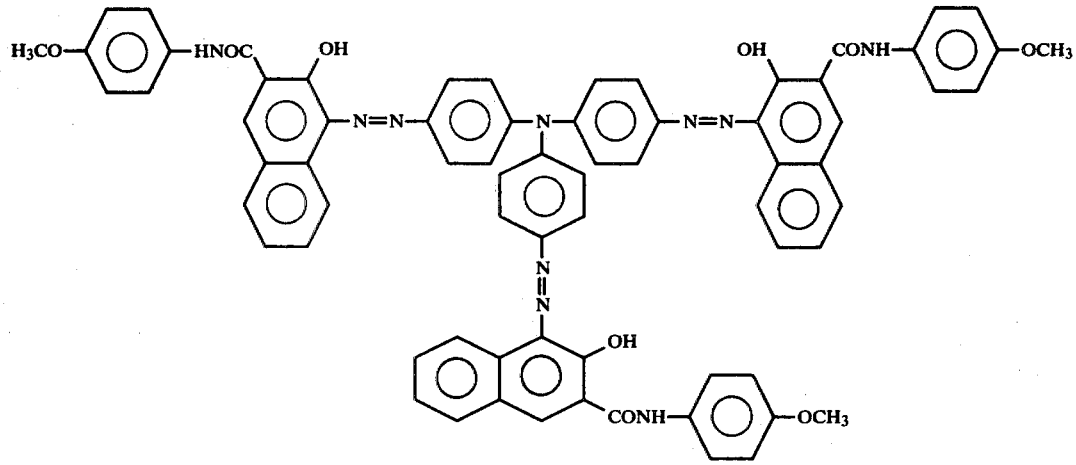

This element was measured as to Vpo and $E_{\frac{1}{2}}$ with the results:

Vpo = −1030V and $E_{\frac{1}{2}}$ = 7.3 lux·sec.

EXAMPLE 8

The same procedure as Example 1 was repeated with the exception that the compound having the following formula was employed as the charge generation pigment:

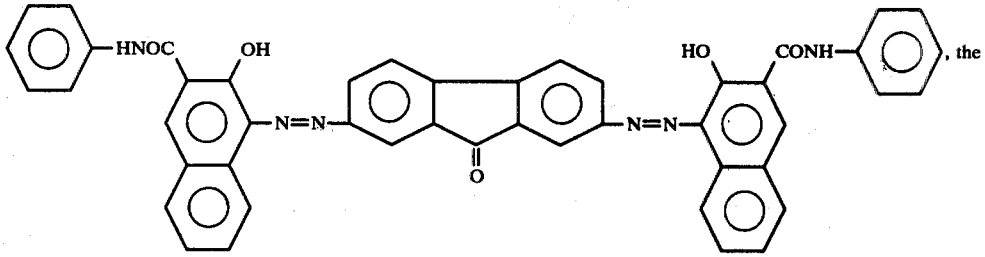

, the hydrazone having the structural formula (26) was employed as the charge transport material, and the charge generation layer and the charge transport layer were made 0.5 micron and 12 microns thick respectively, thereby obtaining an element. This element was measured with the result: $E_{\frac{1}{2}}$ = 3.8 lux·sec.

EXAMPLE 9

The same procedure as Example 1 was repeated with the exception that the compound having the following formula was employed as the charge generation pigment:

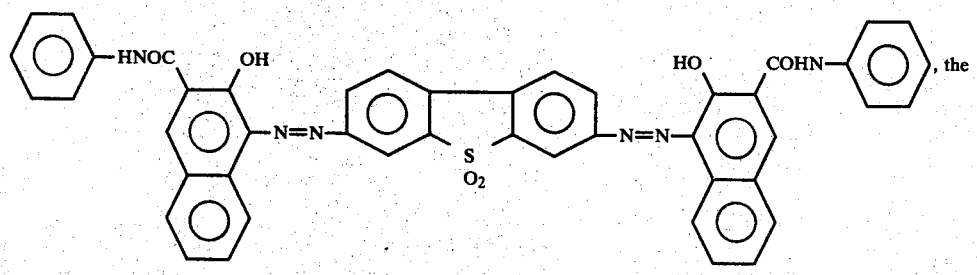

hydrazone having the structural formula (29) was employed as the charge transport material, and the charge generation layer was made 0.6 micron thick, thereby obtaining an element. This element was measured with the result: $E_{\frac{1}{2}}=18.5$ lux·sec.

EXAMPLE 10

The same procedure as Example 1 was repeated with the exception that the compound having the following formula was employed as the charge generation pigment:

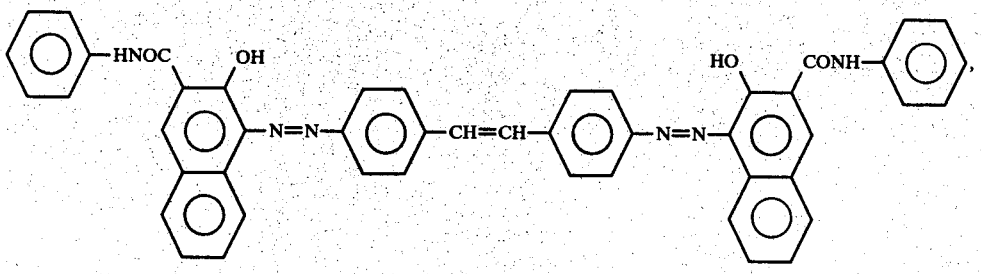

the hydrazone having the structural formula (32) was employed as the charge transport material, and the charge generation layer was made 0.2 micron thick, thereby obtaining an element. This element was measured with the result: $E_{\frac{1}{2}}=35.0$ lux·sec.

EXAMPLE 11

The same procedure as Example 1 was repeated with the exception that the compound having the following formula was employed as the charge generation pigment:

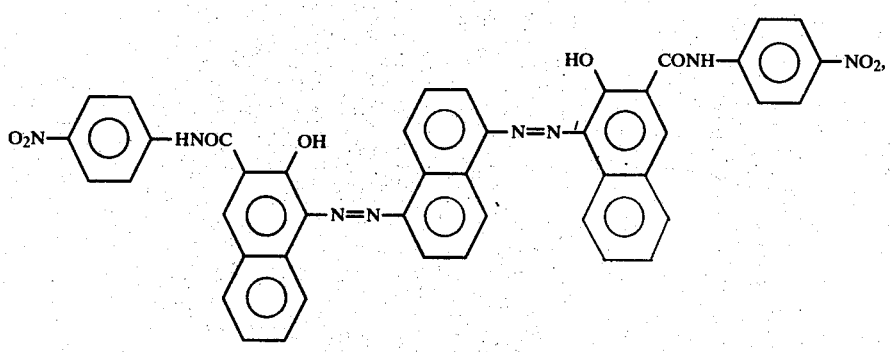

the hydrazone having the structural formula (35) was employed as the charge transport material, and the charge generation layer was made 0.1 micron thick, thereby obtaining an element. This element was measured with the result: $E_{\frac{1}{2}}=3.5$ lux·sec.

EXAMPLE 12

To 2 parts of Dian Blue (CI 21180) were added 98 parts of tetrahydrofuran. The resulting mixture was pulverized and mixed in a ball mill, thereby obtaining a charge generation pigment solution. This solution was coated onto an aluminum evaporation deposited polyester film by means of a doctor blade and air-dried thereby to form a 1 micron-thick charge generation layer. Subsequently, a charge transport layer forming solution was obtained by mixing 2 parts of hydrazone having the structural formula (22), 3 parts of polycarbonate resin (available under the Trademark Panlite L from TEIJIN) and 45 parts of tetrahydrofuran and dissolving them well. This solution was coated onto said charge generation layer by means of a doctor blade and the same was dried at 100° C. for 10 minutes, thereby forming a charge transport layer being about 10 microns thick. The instant element was thus prepared. This element was subjected to −6 KV corona discharge for 20 seconds by means of an electrostatic copying paper tester (SP 408 type available from KAWAGUCHI DENKI SEISAKUSHO K.K.) and charged negatively. Thereafter, the negatively charged element was left standing in the dark for 20 seconds in order to measure the surface potential Vpo (V) at that time, and then was exposed to light from a tungsten lamp so that the surface intensity became 20 lux. Then, the time (seconds) required until the surface potential was reduced to half of said Vpo was measured to determine the exposure amount $E_{\frac{1}{2}}$ (lux·sec). The obtained results showed: Vpo = −850V and $E_{\frac{1}{2}}$ = 4.2 lux·sec.

The elements obtained according to Example 1 to Example 12 were charged negatively by means of a commercially available copying machine. The thus charged elements were then exposed through an original to light, thereby permitting the formation of an electrostatic latent image thereon. This electrostatic latent image was developed by using a positively charged toner-containing dry developer. The thus developed image was electrostatically transferred onto the surface of paper (wood free paper) and fixed, whereby a clear-cut image was obtained. A clear-cut image was likewise obtained when a wet developer was used.

What is claimed is:

1. In an electrophotographic element comprising a charge generation layer and a charge transport layer superposed on an electrically conductive substrate, the improvement which comprises: said charge transport layer contains at least one hydrazone compound having the formula:

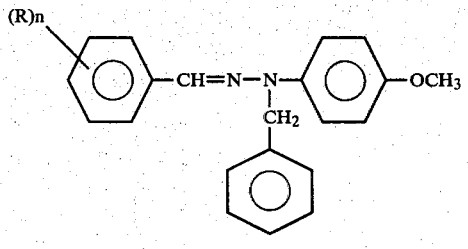

wherein R is hydrogen, alkyl having from one to six carbon atoms, alkoxy having from one to six carbon atoms, halogen, nitro or hydroxyl, n is an integer of 1–5, and when n is 2 or more, R is the same or different; and a binder.

2. An electrophotographic element as claimed in claim 1, wherein said charge transport layer contains a hydrazone compound selected from the group consisting of:

(1)

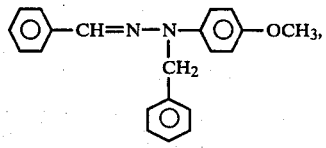

(2)

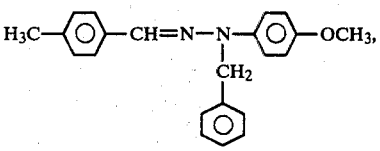

(3)

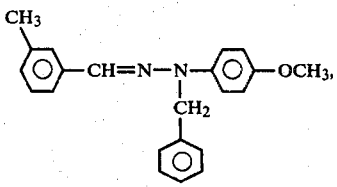

-continued (4)

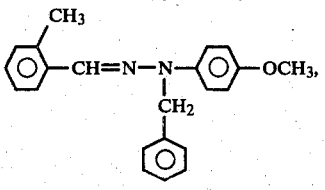

(5)

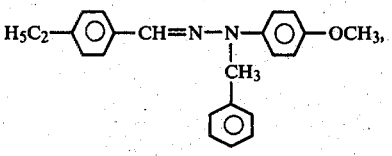

(6)

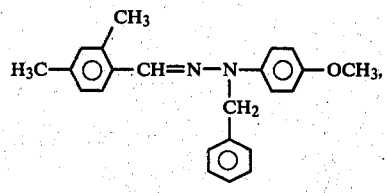

(7)

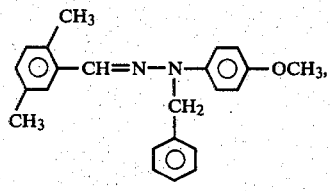

(8)

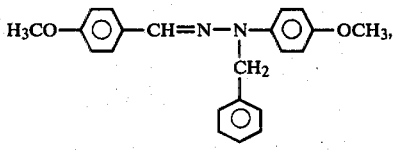

(9)

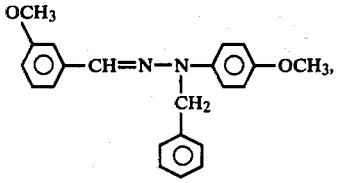

(10)

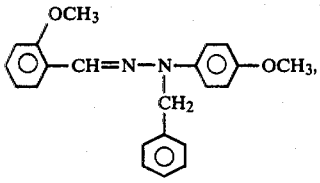

(11)

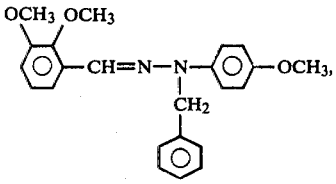

(12)

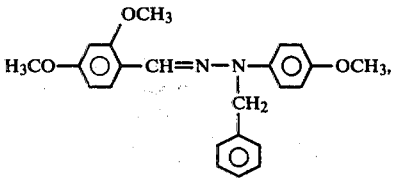

-continued
(13)
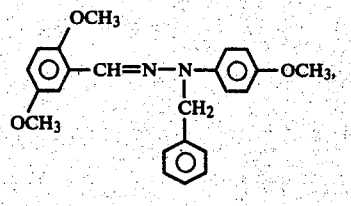
(14)
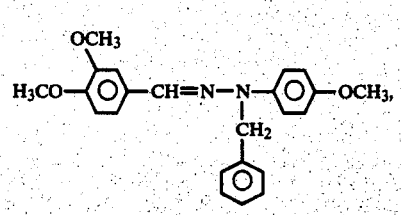
(15)
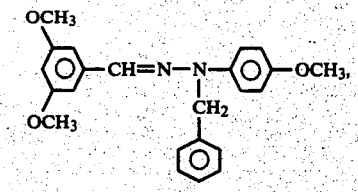
(16)
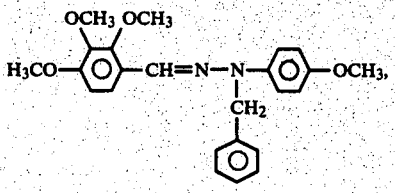
(17)
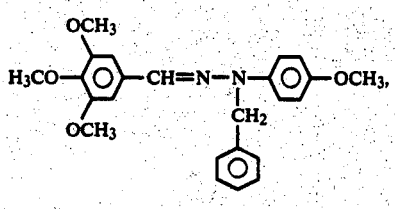
(18)
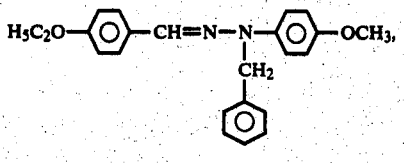
(19)
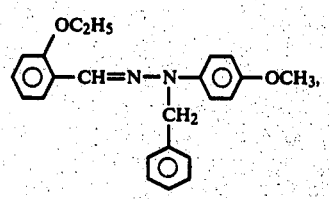
(20)
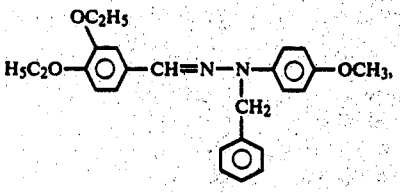
-continued
(26)
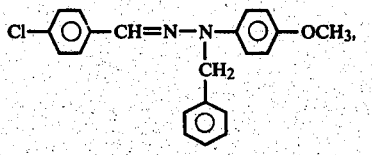
(27)
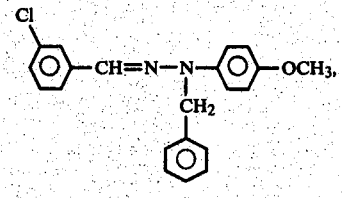
(28)
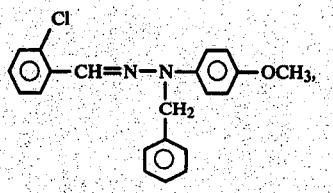
(29)
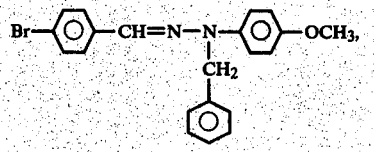
(30)
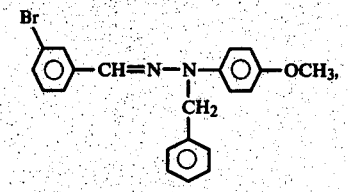
(31)
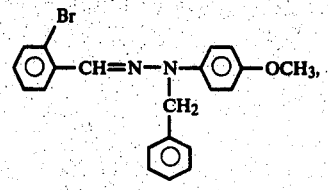
(32)
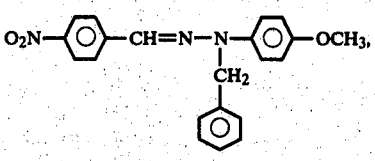
(33)
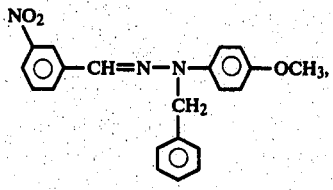
(34)
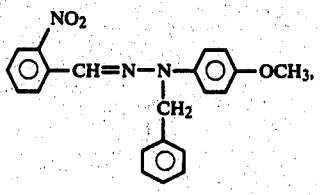

-continued (35)

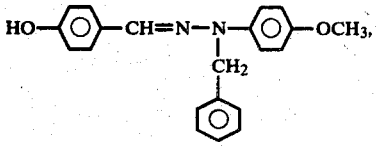

(36)

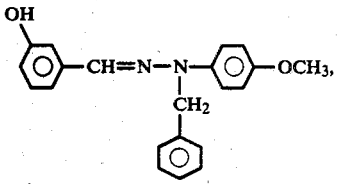

and (37)

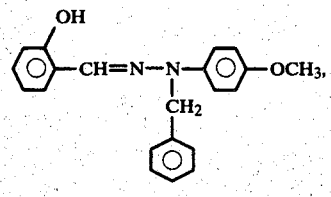

3. An electrophotographic element as claimed in claim 1, wherein said charge transport layer contains a hydrazone compound selected from the group consisting of:

(1)

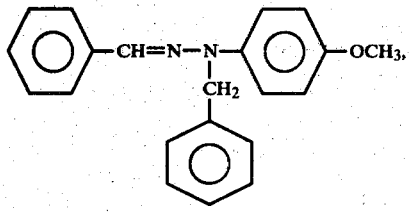

(2)

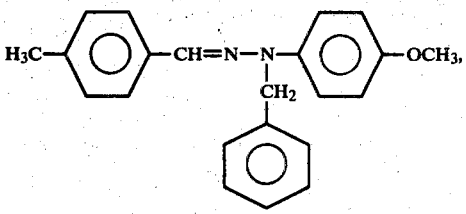

(8)

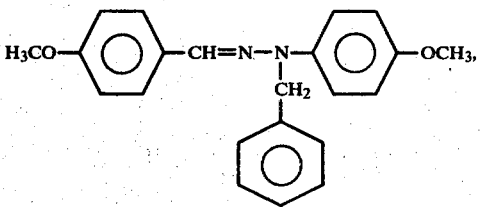

(26)

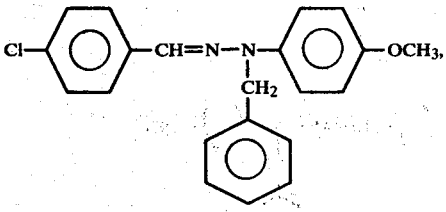

-continued (29)

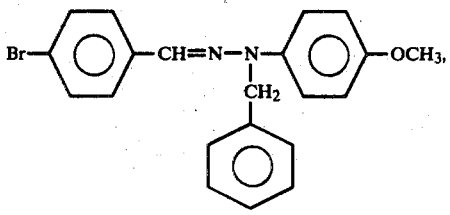

(32)

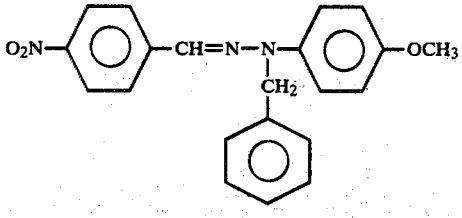

and (35)

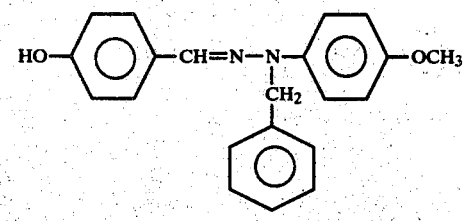

4. An electrophotographic element as claimed in claim 1, wherein said charge transport layer contains a hydrazone compound selected from the group consisting of:

(2)

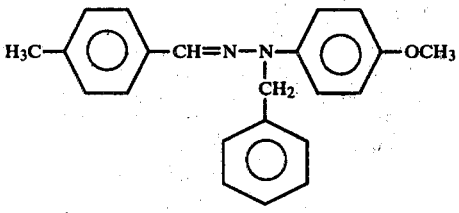

and

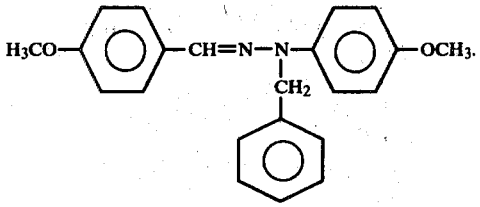

5. An electrophotographic element as claimed in claim 1, wherein said charge generation layer is interposed between said electrically conductive substrate and said charge transport layer, with said charge transport layer forming the exposed surface of said electrophotographic element.

6. An electrophotographic element as claimed in claim 1, wherein said charge generation layer has a thickness in the range of about 0.1 to 5 microns, and said charge transport layer has a thickness in the range of about 3 to 50 microns.

7. An electrophotographic element as claimed in claim 6, wherein said charge transport layer is between 5 microns and 20 microns thick.

8. An electrophotographic element as claimed in claim 1, wherein said charge generation layer contains a charge generation material selected from the group consisting of selenium, selenium alloys, azo pigments and perylene pigments.

9. An electrophotographic element as claimed in claim 1, wherein said charge generation layer contains a charge generation material selected from the group consisting of azo pigments having a styrylstilbene skeleton, azo pigments having a carbazole skeleton, azo pigments having a triphenylamine skeleton, azo pigments having a fluorenone skeleton, azo pigments having a diphenylene sulfone skeleton, azo pigments having a stilbene skeleton, azo pigments having a naphthalene skeleton and azo pigments having a biphenylene skeleton.

10. An electrophotographic element as claimed in claim 1, wherein said charge generation layer contains an azo pigment having a styrylstilbene skeleton.

11. An electrophotographic element as claimed in claim 1, or claim 3 wherein said charge generation layer contains 1,4-bis[4-{2-hydroxy-3-(2,4-dimethylphenyl)-carbamoylnaphthyl-1}azostyryl-1]benzene.

12. An electrophotographic element as claimed in claim 1, wherein said binder is selected from the group consisting of polyamide, polyurethane, polyester, epoxy resin, polyketone, polycarbonate, polyvinyl ketone, polystyrene, poly-N-vinylcarbazole, polyacrylamide, acrylic resin, and polyvinyl acetal.

13. In an electrophotographic element comprising, in successive layers, an electrically conductive substrate, a charge generation layer and a charge transport layer, the improvement which comprises: said charge generation layer contains a charge generation material selected from the group consisting of selenium, its alloys, azo pigments and perylene pigments, and said charge transport layer contains at least one hydrazone compound having the formula:

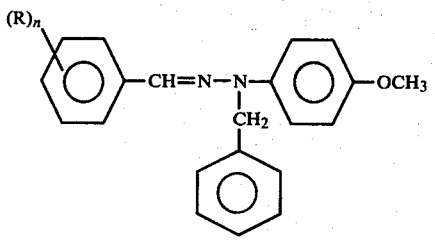

wherein R is hydrogen, alkyl having from one to six carbon atoms, alkoxy having from one to six carbon atoms, halogen, nitro or hydroxyl, n is an integer of 1–5, and where n is 2 or more, R is the same or different; and a binder.

14. An electrophotographic element as claimed in claim 13, wherein said charge transport layer contains a hydrazone compound selected from the group consisting of:

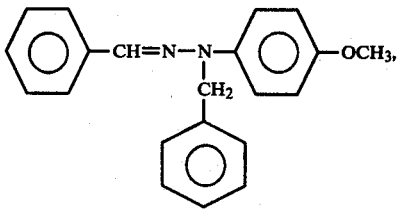

(1)

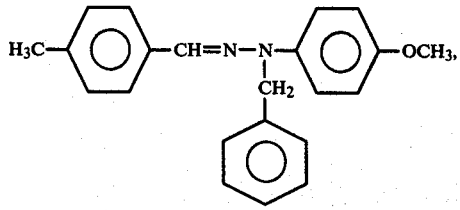

(2)

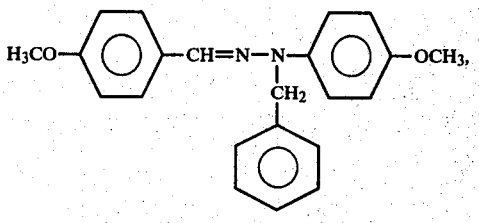

(8)

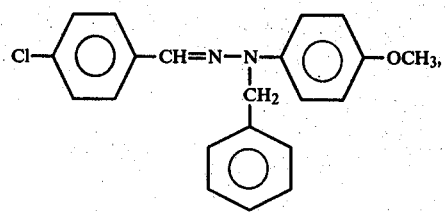

(26)

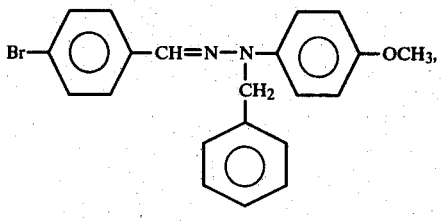

(29)

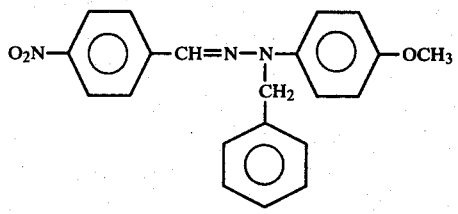

(32)

and

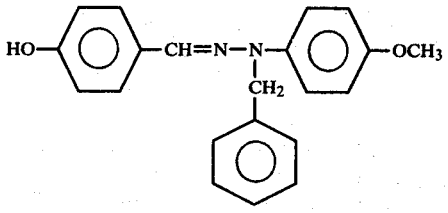

(35)

* * * * *

UNITED STATES PATENT AND TRADEMARK OFFICE

CERTIFICATE OF CORRECTION

PATENT NO. : 4 387 147

DATED : June 7, 1983

INVENTOR(S) : Kiyoshi Sakai

It is certified that error appears in the above-identified patent and that said Letters Patent is hereby corrected as shown below:

Column 20, line 63; change "0.1" to ---0.01---.

Signed and Sealed this

*Eighteenth* Day of *October 1983*

[SEAL]

*Attest:*

GERALD J. MOSSINGHOFF

*Attesting Officer*

*Commissioner of Patents and Trademarks*